US007137150B2

(12) United States Patent
Larson

(10) Patent No.: US 7,137,150 B2
(45) Date of Patent: Nov. 21, 2006

(54) DICKEY WITH HEAD COVER

(76) Inventor: Van Larson, 513 S. Sixth St., Grand Forks, ND (US) 58201

( * ) Notice: Subject to any disclaimer, the term of this patent is extended or adjusted under 35 U.S.C. 154(b) by 0 days.

(21) Appl. No.: 10/923,494

(22) Filed: Aug. 20, 2004

(65) Prior Publication Data

US 2005/0050612 A1 Mar. 10, 2005

Related U.S. Application Data

(60) Provisional application No. 60/497,287, filed on Aug. 22, 2003.

(51) Int. Cl.
*A42B 1/04* (2006.01)

(52) U.S. Cl. ..... 2/202; 2/410; 2/209.13

(58) Field of Classification Search ..... 2/46, 2/49.1, 90, 92, 103, 202, 206, 410
See application file for complete search history.

(56) References Cited

U.S. PATENT DOCUMENTS

| | | | | |
|---|---|---|---|---|
| 1,686,258 | A | 10/1928 | Schlesinger | |
| 2,839,757 | A | 6/1958 | Gianola | |
| 4,180,868 | A | 1/1980 | Snow | |
| 4,286,170 | A * | 8/1981 | Moti | 250/515.1 |
| 4,641,380 | A | 2/1987 | Epstein | |
| 4,768,235 | A | 9/1988 | Webster | |
| 4,833,732 | A * | 5/1989 | Harmsen | 2/102 |
| D304,257 | S * | 10/1989 | Dorning | D2/854 |
| 5,091,996 | A | 3/1992 | Kirby | |
| 5,115,517 | A | 5/1992 | Ferguson et al. | |
| 5,211,668 | A * | 5/1993 | Secord | 2/203 |
| 5,251,336 | A | 10/1993 | Nevins | |
| 5,675,838 | A * | 10/1997 | Hollinger | 2/69 |
| 5,704,068 | A | 1/1998 | Martin | |
| 5,713,076 | A * | 2/1998 | Davis | 2/4 |
| 5,765,230 | A | 6/1998 | Sivret et al. | |
| 5,822,800 | A | 10/1998 | Anderson | |
| D406,936 | S | 3/1999 | Sivret et al. | |
| 5,924,129 | A * | 7/1999 | Gill | 2/10 |
| 5,960,478 | A | 10/1999 | Sivret et al. | |
| 6,023,787 | A | 2/2000 | French et al. | |
| 6,088,838 | A * | 7/2000 | Sontag | 2/202 |
| 6,260,206 | B1 | 7/2001 | MacDonald et al. | |
| 6,272,690 | B1 | 8/2001 | Carey et al. | |
| 6,532,596 | B1 * | 3/2003 | Fosmo | 2/49.1 |
| 2004/0098789 | A1 * | 5/2004 | Carey | 2/173 |

OTHER PUBLICATIONS

Margaret's Dickeys, Hand Crafted Fleece Dickies, 2 pages, Aug. 20, 2003.

* cited by examiner

*Primary Examiner*—Katherine M. Moran
(74) *Attorney, Agent, or Firm*—Robert D. Atkins; Quarles & Brady Streich Lang LLP

(57) ABSTRACT

A dickey with head cover is disclosed. The dickey with head cover includes a hat capable of covering at least a portion of the wearer's head, and a dickey. The hat releasably attaches to the dickey. The dickey includes a shoulder yoke portion attached to the dickey to form an integral torso covering. The invention may also be used where the head cover is attached to a gaiter. The invention may also relate to attaching a gaiter to a head cover.

17 Claims, 5 Drawing Sheets

DICKEY WITH HEAD COVER

RELATED APPLICATION

The present application claims the benefit of U.S. Provisional Application No. 60/497,287 filed Aug. 22, 2003, which is incorporated herein in its entirety by reference.

FIELD OF THE INVENTION

The present invention relates generally to the field of cold weather garments. More specifically, the present invention relates to an adjustable dickey having a hat and shoulder yoke.

BACKGROUND OF THE INVENTION

In cold weather climates, it is a frequent desire of persons exposed to frigid temperatures to have some form of face and neck protection when outdoors. One of the most common garments used to offer such protection is the traditional scarf, which can be tied in place about the person's neck and can then be adjusted over the face as desired by the wearer. Scarves suffer from a variety of drawbacks such as being difficult for children to tie as well as the potential for coming untied, thus eliminating their protection during use.

In light of the deficiencies of scarves, dickeys have been developed for use in cold weather situations. The traditional dickey is a tubular garment designed to fit over the wearer's head and reside around the wearer's neck. With the dickey's tubular design, no tying is required and the dickey cannot be removed except by the wearer deliberately sliding the dickey over their head. The dickey typically has a width allowing it to be rolled or "scrunched" up so that it resides only on the neck area, or alternatively, the dickey can be stretched to cover the face area below the eyes in addition to the neck area.

While dickeys overcome many of the disadvantages associated with the traditional scarves, dickeys do not provide additional benefits such as head coverage, jacket collar coverage or seamless transitions between the head and torso that hunting enthusiasts find beneficial in pursuing their sport.

Due to these concerns, a number of dickey designs incorporating head protection means, have been suggested. Examples of such designs include U.S. Pat. Nos. 1,686,258 to Schlesinger; U.S. Pat. No. 4,180,868 to Snow; U.S. Pat. No. 4,641,380 to Epstein; U.S. Pat. No. 5,091,996 to Kirby; U.S. Pat. No. 5,115,517 to Ferguson et al.; U.S. Pat. No. 5,765,230 to Sivret et al.; U.S. Pat. No. 5,822,800 to Anderson; U.S. Pat. No. 6,088,838 to Sontag; and U.S. Pat. No. 6,260,206 to MacDonald et al.; all of which are hereby incorporated by reference in their entirety.

In particular, U.S. Pat. No. 5,822,800 to Anderson describes a multi-functional hat where the hat has a tubular fabric body. The hat portion of the multi-functional hat takes on the form of a hood with a face opening in the front of the head covering.

A number of the above-identified patents also include a hood structure. For example, U.S. Pat. No. 5,115,517 to Ferguson et al. describes a scarf garment that is attached to the lower part of a hood shaped hat.

U.S. Pat. No. 1,686,258 to Schlesinger describes a stocking cap structure wherein a zipper along the band of the stocking cap is unzipped and the lower portion of the band extends under the chin, covering part of the neck. The chin and area under the chin may be covered by the band, but the neck area, in general, is not covered.

Although dickeys are known in the art, there is still a need for coverage additional to the dickey such as head coverage, jacket collar coverage or seamless transitions between the head and torso.

SUMMARY OF THE INVENTION

The adjustable dickey of the present invention provides a user, typically a hunter, with a combination of protective and concealing features that are beneficial when in the field. More specifically, the present invention combines a traditional dickey with a hat portion and a shoulder yoke portion to provide a one-piece garment for hunters.

The hat portion can comprise a number of different styles and appearances. Typically, the hat portion comprises a common stocking cap design to fit snugly and comfortably over the wearer's head.

The shoulder yoke portion can comprise a number of different styles and appearances. Typically, the shoulder yoke portion comprises a front portion and a rear portion attached to the dickey. The front portion and rear portion are joined together at a pair of shoulders, which are adapted to fit over a wearer's shoulders.

In one embodiment, the dickey of the present invention provides features suitable for protection of a wearer in a cold weather climate. The dickey of the present invention is capable of simultaneously offering exposure protection to the head, face, and neck, as well as eliminating the intrusion of wind or precipitation through a wearer's neck area.

In another embodiment, the dickey of the present invention provides concealment features designed for seamless transition with a hunter's camouflaged attire. The dickey of the present invention is capable of simultaneously camouflaging the wearer's head, face and neck while the shoulder yoke provides a seamless transition from the head to the torso of the wearer.

DETAILED DESCRIPTION OF THE PREFERRED EMBODIMENTS

Figure 1:
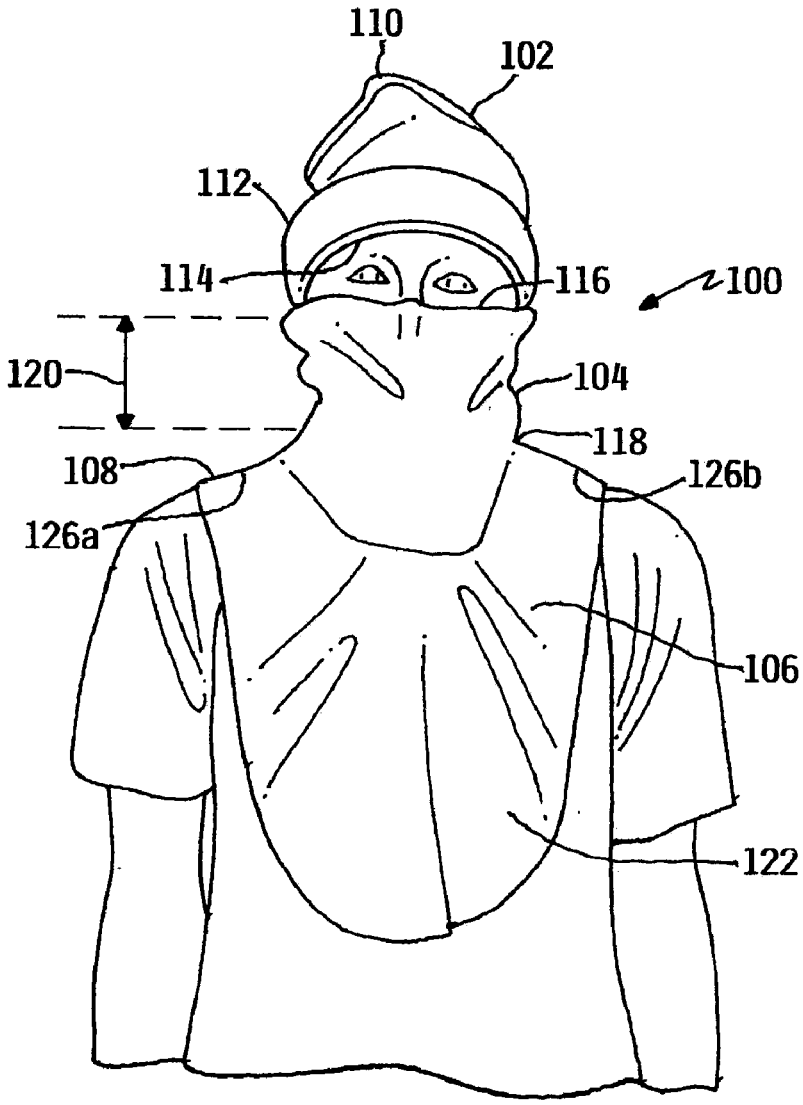
FIG. 1 is a front view of a user wearing a dickey with head cover of the present invention.
Figure 2:
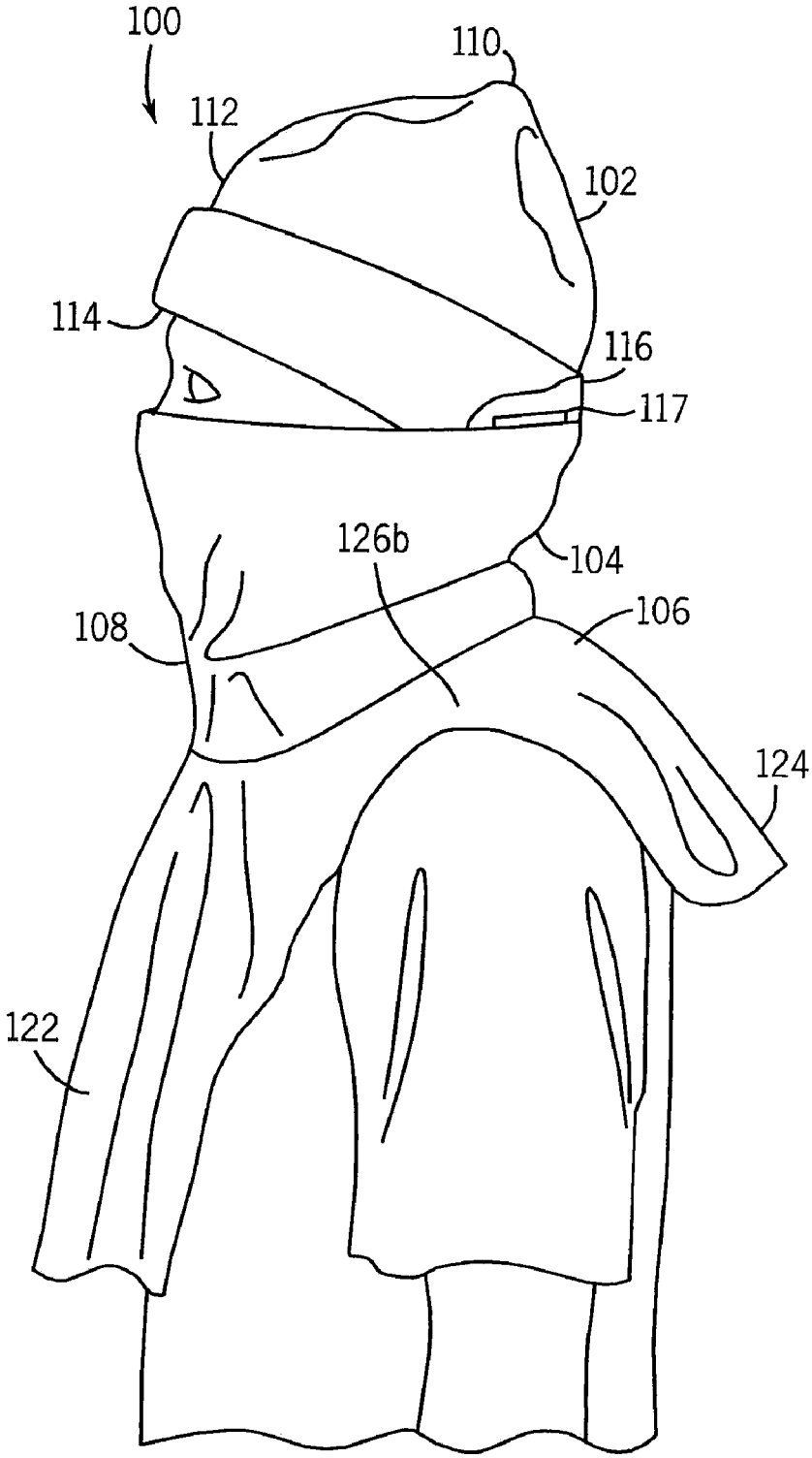
FIG. 2 is a side view of a user wearing the dickey with head cover of FIG. 1.
Figure 3:
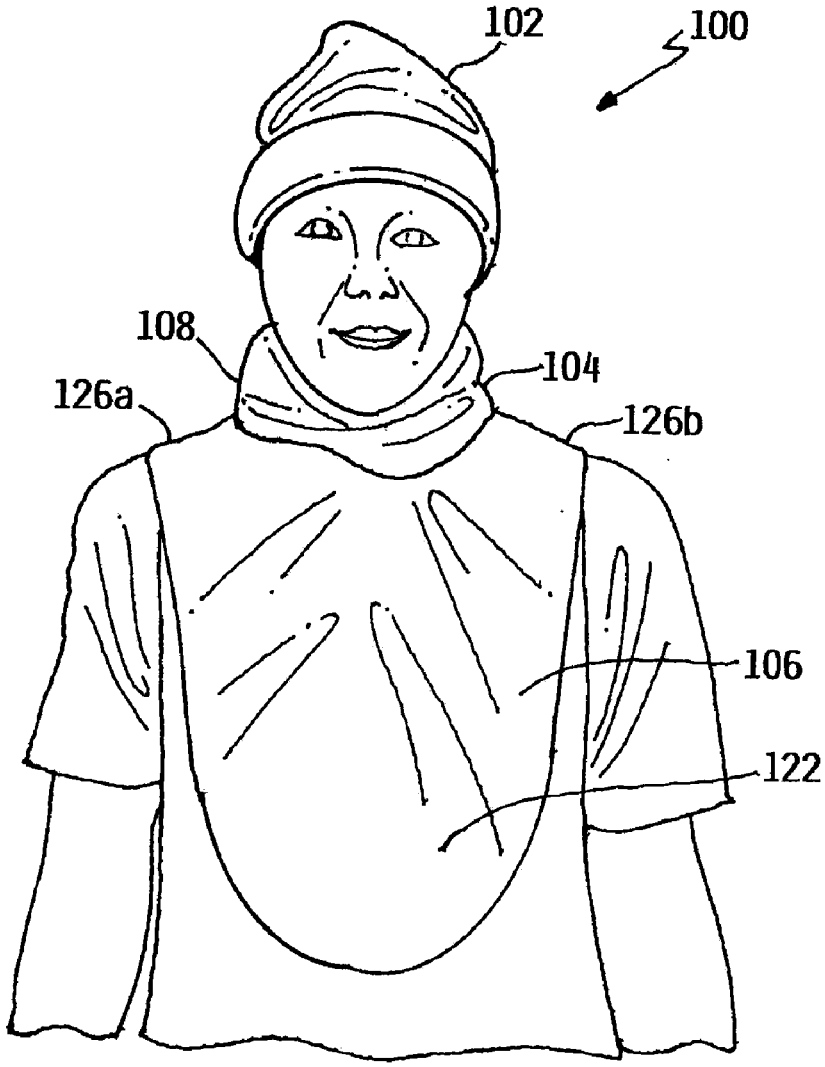
FIG. 3 is a front view of a user wearing the dickey with head cover of FIG. 1 in an alternate configuration

As illustrated in FIGS. 1, 2 and 3, a dickey with head cover 100 of the present invention comprises a hat portion 102, a dickey portion 104 and a shoulder yoke portion 106.

Preferably, dickey with head cover 100 is manufactured of a single type of fabric 108. Alternatively, dickey 100 could be made of a plurality of different fabrics. The present invention also relates to a gaiter with head cover where the gaiter only covers the wearer's neck area.

Generally, fabric 108 is manufactured of a material that is both comfortable when worn and suitable for outdoor use. Examples of suitable materials could include wool, polyester, polar fleece, cotton, Gore-Tex® brand waterproof fabric, nylon or other suitable materials. In addition, these materials may include certain other desirable characteristics for outdoor use such as waterproofing, wind and/or water resistance, insulation and breathability.

Fabric 108 can comprise a variety of different colors and/or appearances based on the intended use. Most preferably, fabric 108 includes colors and shapes creating a camouflaged appearance selectively chosen to blend into certain outdoor environments to reduce the potential for a user, such as a hunter, being seen by their prey. Alternatively, fabric 108 can include bright, highly visible colors such as blaze orange or red to impart high visibility in the field.

Typically, hat portion 102 resembles a traditional stocking cap or baseball cap design having a peak 110 and a circular perimeter 112 adapted to snugly fit over a wearer's head. Preferably, hat portion 102 is adapted to fit comfortably over a wide range of head sizes. Depending upon a wearer's head size and for potential comfort reasons, an opening surface 114 defining the head opening can be rolled upward to potentially provide more protection over the ears of a wearer.

Dickey portion 104 has a tubular configuration including a top surface 116, a bottom 118 and a width 120. The dimensions of dickey portions 104 are preferably selected based upon the size of the person that will be wearing the present invention as well as the portion of the wearer's face that is to be covered by the invention.

Figure 4:
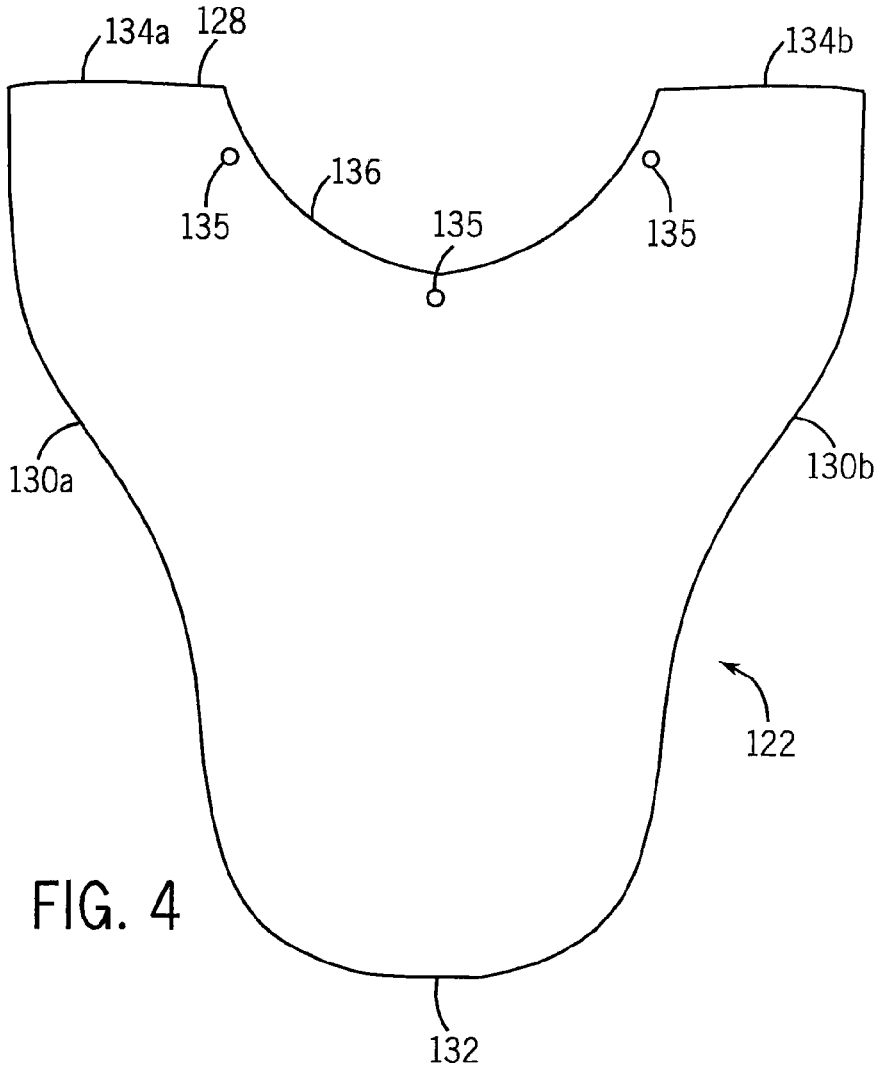
FIG. 4 is a top view of a front portion of a shoulder yoke.
Figure 5:
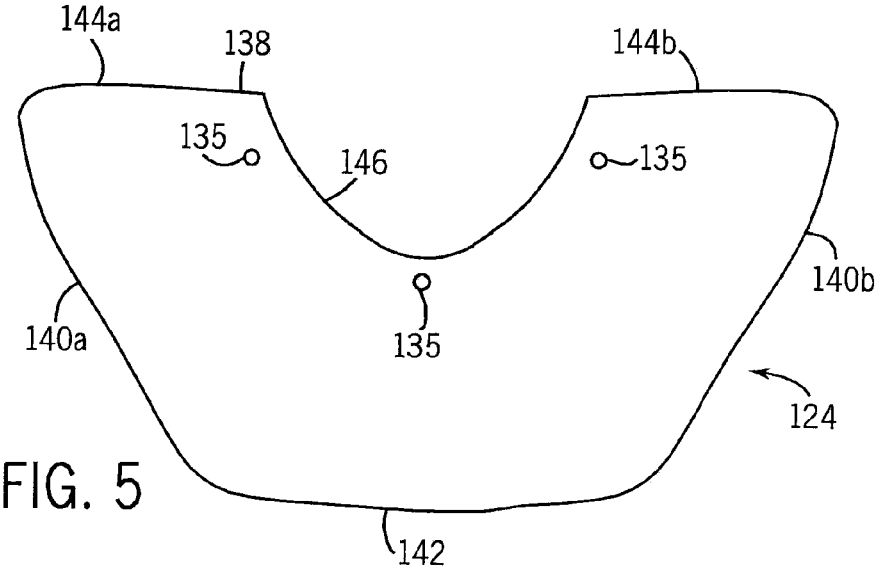
FIG. 5 is a top view of a rear portion of a shoulder yoke.

Shoulder yoke portion 106 preferably comprises a front portion 122 as shown in FIG. 4 and a rear portion 124 as shown in FIG. 5 joined at a pair of shoulder portions 126*a*, 126*b*. Front portion 122 is defined by a front upper surface 128, a pair of front side surfaces 130*a*, 130*b* and a front bottom surface 132. Front upper surface 128 is defined by a pair of front shoulder surfaces 134*a*, 134*b* and a front arcuate surface 136. Rear portion 124 is defined by a rear upper surface 138, a pair of rear side surfaces 140*a*, 140*b* and a rear bottom surface 142. Rear upper surface 138 is defined by a pair of rear shoulder surfaces 144*a*, 144*b* and a rear arcuate surface 146.

Generally, dickey with head cover 100 is assembled by attaching hat portion 102 to dickey portion 104. A variety of fastening methods could be employed including removable fastening means 117 in FIG. 2 such as zippers, hook and loop fasteners, buttons and snaps.

Shoulder yoke portion 106 is formed by attaching front portion 122 with rear portion 124. This is accomplished by sewing front shoulder surface 134*a* to rear shoulder surface 144*b* and front shoulder surface 134*b* to rear shoulder surface 144*a*.

Shoulder yoke portion 106 is attached to dickey portion 104 by sewing fronL arcuate surface 136 and rear arcuate surface 146 to bottom 118. Alternatively, yoke portion 106 may be releasably attached to dickey portions 104 such as with zippers, hook and loop fasteners and snaps 135 as shown in FIGS. 4 and 5.

In use, dickey 100 is worn by first pulling dickey portion 104 over a wearer's head such that dickey portion 104 resides over the neck area. Dickey 100 is oriented such that front portion 122 extends over the front buttons of the wearer's body while rear portion 124 extends over the rear of the wearer's body with shoulder portions 126*a*, 126*b* residing over the wearer's shoulders. Hat portion 102 can then be pulled over and adjusted on the wearer's head while the dickey portion 104 can be adjusted over the face by pulling the top surface 116 upwards.

Generally, dickey with head cover 100 is worn such that shoulder yoke portion 106 is worn inside of a wearer's jacket or coat. In this orientation, the dickey with head cover 100 enhances the overall comfort of the wearer by enhancing the protection provided by the wearer's coat or jacket.

It will be readily apparent that dickey with head cover 100 can take multiple forms without departing from the spirit and scope of the present invention. Although various embodiments of the present invention have been disclosed here for purposes of illustration, it should be understood that a variety of changes, modifications and substitutions may be incorporated without departing from either the spirit or scope of the present invention.

What is claimed is:

1. An article of apparel for covering an upper body portion of a person, comprising:

a hat portion made with a fabric suitable for providing protection from outdoor elements;

a dickey portion having a tubular configuration, the dickey portion being made with the fabric of the hat portion and having sufficient surface area to cover substantially an entire face of the person;

a first releasable attachment mechanism that attaches and detaches the hat portion to the dickey portion;

a yoke portion made with the fabric of the hat and dickey portions, the yoke portion being made from separate front and rear pieces which are sewn together at common shoulder surfaces; and a second releasable attachment mechanism that attaches and detaches the dickey portion to the yoke portion.

2. The article of apparel of claim 1, wherein the first and second releasable attachment mechanisms are each selected from a group comprising a zipper, snaps, buttons, slide, and hook and loop fasteners.

3. The article of apparel of claim 1, wherein the fabric is selected from the group consisting of wool, polyester, polar fleece, cotton, nylon, and waterproof material.

4. The article of apparel of claim 1, wherein the hat is waterproof or wind-resistant.

5. The article of apparel of claim 1, wherein the fabric has a camouflaged appearance or high-visibility coloring.

6. An article of apparel for covering an upper body portion of a person, comprising:

a hat portion made with a fabric suitable for providing protection from outdoor elements;

a gaiter portion having a tubular configuration, the gaiter portion being made with the fabric of the hat portion; a first releasable attachment mechanism that attaches and detaches the hat portion to the gaiter portion;

a yoke portion made with the fabric of the hat and gaiter portions, the yoke portion being made from separate front and rear pieces which are sewn together at common shoulder surfaces; and a second releasable attachment mechanism that attaches and detaches the gaiter portion to the yoke portion.

7. The article of apparel of claim 6, wherein the first and second releasable attachment mechanisms are each selected from a group comprising a zipper, snaps, buttons, slide, and hook and loop fasteners.

8. The article of apparel of claim 6, wherein the fabric is selected from the group consisting of wool, polyester, polar fleece, cotton, nylon, and waterproof material.

9. The article of apparel of claim 6, wherein the gaiter portion is capable of covering a wearer's neck and a portion of the wearer's face.

10. The article of apparel of claim 6, wherein the hat portion is waterproof or wind-resistant.

11. The article of apparel of claim 6, wherein the fabric has a camouflaged appearance or high-visibility coloring.

12. An article of apparel for use by a person, comprising:

a head covering portion made with a fabric suitable for providing protection from outdoor elements;

a tubular, neck and face covering portion made with the fabric of the head covering portion and having sufficient surface area to cover substantially an entire face of the person;

a first releasable attachment mechanism that attaches and detaches the head covering portion to the neck and face covering portion;

a body covering portion made with the fabric of the head covering portion, the body covering portion being made from separate front and rear pieces which are sewn together at common shoulder surfaces; and a second releasable attachment mechanism that attaches and detaches the neck and face covering portion to the body covering portion.

13. The article of apparel of claim 12, wherein the first and second releasable attachment mechanisms are each selected from the group comprising a zipper, snaps, buttons, slide, and hook and loop fasteners.

14. The article of apparel of claim 12, wherein the fabric is selected from the group consisting of wool, polyester, polar fleece, cotton, nylon, and waterproof material.

15. A method of manufacturing an article of apparel for covering an upper body portion of a person, comprising:

providing a head covering portion made with a fabric suitable for providing protection from outdoor elements;

providing a tubular, neck and face covering portion made with the fabric of the head covering portion and having sufficient surface area to cover substantially an entire face of the person;

providing a first releasable attachment mechanism that attaches and detaches the head covering portion to the neck and face covering portion;

providing a body covering portion made with the fabric of the head covering portion, the body covering portion being made from separate front and rear pieces which are sewn together at common shoulder surfaces; and providing a second releasable attachment mechanism that attaches and detaches the neck and face covering portion to the body covering portion.

16. The method of claim 15, wherein the first and second releasable attachment mechanisms are each selected from the group comprising a zipper, snaps, buttons, slide, and hook and loop fasteners.

17. The method of claim 15, wherein the fabric is selected from the group consisting of wool, polyester, polar fleece, cotton, nylon, and waterproof material.

* * * * *

UNITED STATES PATENT AND TRADEMARK OFFICE

CERTIFICATE OF CORRECTION

PATENT NO. : 7,137,150 B2
APPLICATION NO. : 10/923494
DATED : November 21, 2006
INVENTOR(S) : Van Larson and Jon Larson It is certified that error appears in the above-identified patent and that said Letters Patent is hereby corrected as shown below:

On first page of patent Item (75) please add second inventor information as follows:

-- Jon Larson, 1401 Dyke Avenue, Grand Forks, ND (US) 58208 --

Signed and Sealed this

Twentieth Day of February, 2007

JON W. DUDAS
*Director of the United States Patent and Trademark Office*